US006182933B1

(12) United States Patent
Rapp

(10) Patent No.: US 6,182,933 B1
(45) Date of Patent: Feb. 6, 2001

(54) FRICTION-MOUNTABLE HANGER

(76) Inventor: Daniel T. Rapp, 6632 Spruce Dr., Cannon Falls, MN (US) 55009

( * ) Notice: Under 35 U.S.C. 154(b), the term of this patent shall be extended for 0 days.

(21) Appl. No.: 09/316,901

(22) Filed: May 22, 1999

(51) Int. Cl.[7] ..... A47B 96/06; E04G 5/06
(52) U.S. Cl. ..... 248/231.81; 248/231.31
(58) Field of Search ..... 248/231.31, 231.81, 248/205.1, 237, 74.2

(56) References Cited

U.S. PATENT DOCUMENTS

| | | | | |
|---|---|---|---|---|
| 1,495,485 | | 5/1924 | Jersemann . | |
| 1,856,847 | | 5/1932 | Gates . | |
| 2,657,442 | | 11/1953 | Bedford . | |
| 3,074,676 | | 1/1963 | Watson . | |
| 3,181,827 | | 5/1965 | Sassin . | |
| 3,300,168 | * | 1/1967 | Gaudino | 248/231.81 |
| 4,811,475 | | 3/1989 | Morton . | |
| 5,141,192 | | 8/1992 | Adams . | |
| 5,364,050 | | 11/1994 | Smith . | |
| 5,509,632 | | 4/1996 | Mesna et al. . | |
| 5,720,398 | | 2/1998 | Kump et al. . | |

OTHER PUBLICATIONS

"Four Prior Known Extrusion Profiles".

* cited by examiner

*Primary Examiner*—Anita M. King
*Assistant Examiner*—Jerome DeLuca
(74) *Attorney, Agent, or Firm*—R. C. Baker & Associates, Ltd.

(57) ABSTRACT

The friction-mountable plastic hanger has an extrusion profile that defines a stiff depending hook for hanging an object and a cantilevered mounting structure extending from the hook. The cantilevered structure may consist of a single mounting arm with resiliently deformable transversely extending fins angularly projecting from the opposite faces of the arm in a direction backward toward the hook, or a stiff U-shaped mounting structure having a pair of parallel cantilevered mounting arms with interior facing surfaces equipped with resiliently deformable transversely extending fins that angularly project from the interior surfaces of the arms in a direction backward toward the hook. All parts of both have a uniform width dimension that extends perpendicular to the extrusion profile. The fins on the mounting arms are resiliently deformed by bending into a frictionally engaging relationship against structural surfaces when the hangers are frictionally mounted.

19 Claims, 2 Drawing Sheets

FRICTION-MOUNTABLE HANGER

BACKGROUND OF THE INVENTION

This invention relates to a friction-mountable hanger, and more particularly to hangers having a hook for hanging an object and a cantilevered part for frictionally mounting the hook. The invention contemplates the use of a single arm friction mounting element for slidable friction anchoring between face-to-face structural surfaces, and a dual arm U-shaped friction mounting element for slidable friction anchoring over opposite faces of a plate member.

People and businesses have become increasingly dedicated and competitive in decorating their homes and buildings at various times of the year, especially during holiday seasons such as at yuletide. Whether as home decoration or as business promotional decoration, the desire always is to minimize or totally avoid damage to building features or structures while nevertheless effectively implementing whatever decoration is wanted. Insofar as is known, there never has been an effective way to decorate without causing some damage to the base structures. The most common damage is that of small holes caused by nails or prongs or something else pressed into material of the base structure. What people want and have long wanted, however, is a simple way to accomplish decoration without causing damage to base structures. They want to avoid even the smallest of holes or marks or scratches of surfaces or features, whether inside or outside of a building. It is to a solution to this desire that this invention is directed.

SUMMARY OF THE INVENTION

The invention provides a plastic hanger best described by referring to its extrusion profile. The hanger has an extrusion profile that defines a stiff hook for hanging an object and a mounting element that literally relies upon friction to maintain the hanger in position. No prongs, nails, screws, adhesives, or other fasteners are needed. Mere friction gripping does the job. No puncturing of any structure is necessary.

The preferred form of mounting element comprises a stiff cantilevered element. Its extrusion profile may have a single arm or a pair of arms. The arms are formed of stiff plastic and are equipped with resiliently deformable, transversely extending fins that project angularly outward from the arm and backward toward the hook of the hanger. The fins on the single arm mounting element project from each face of it and are designed to frictionally engage opposing face-to-face structural surfaces when the mounting arm is inserted therebetween. Fins on the dual arm U-shaped mounting element project from the internal face surfaces of the two arms and function to engage or anchor the element on opposite faces of a thin structural strip or member such as a plate member. The mounting arms of the U shape are slidably pushed on opposite sides (faces) of the plate member.

Despite the amazing simplicity of the invention, the hangers are totally effective for a multitude of decorative purposes and nevertheless can be easily de-mounted (i.e., removed from mounted condition) without causing damage to base building structures.

The several benefits and advantages and desirable features of the invention will become more evident as this description proceeds.

DETAILED DESCRIPTION OF THE INVENTION

The single mounting arm hanger of the invention will be described first with reference to FIGS. 1, 3, and 4.

It is important to recognize that the hangers of the invention are formed by extrusion of plastics. As such, they have what is called an extrusion profile, that is, a profile defined by the die of extrusion. The profile defines various parts of the hanger. Because some parts of the hanger are formed to be relatively stiff and others are formed to be relatively resilient and deformable but recoverable from deformation, formation of the hanger is by way of co-extrusion of plastic materials of different properties through an extrusion die. In this manner, the different parts of the hanger are fused together (as they are formed) into an integrated unitary whole.

Figure 1:
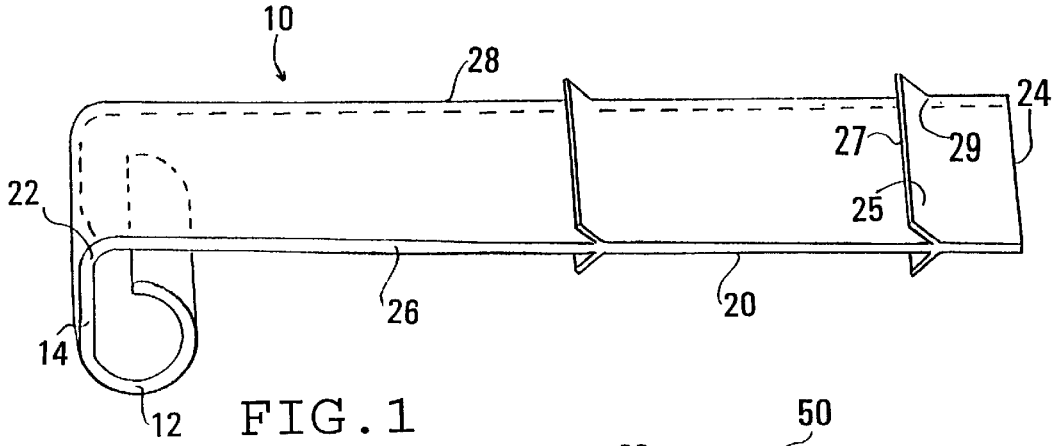
FIG. 1 is a schematic perspective view of the new friction-mountable plastic hanger of the invention equipped with a single arm mounting element.
Figure 4:
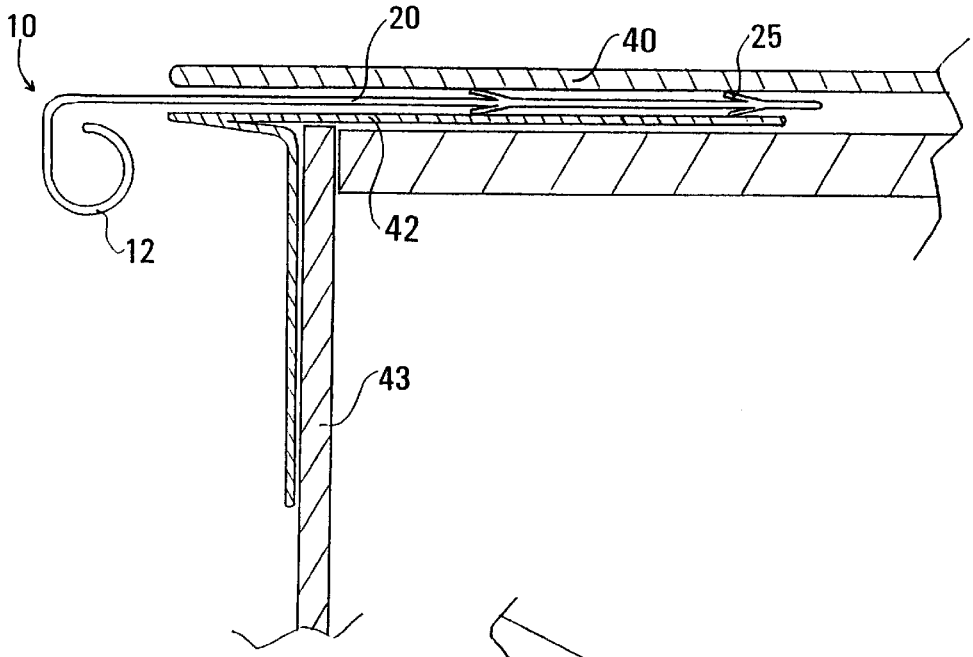
FIG. 4 is a fragmentary schematic sectional view taken at line 4—4 of FIG. 3, illustrating a hanger of the invention having a single arm anchored between face-to-face structural surfaces of a building (with the spacing between parts exaggerated to enhance clarity of the illustration)

The extrusion profile of the single arm hanger 10 of FIGS. 1 and 4 has a stiff hook 12 at the lower end of a stiff depending leg 14. A stiff cantilevered mounting arm 20 extends from an upper base part 22 on the hook leg 14 to the outer end or tip 24 of the cantilevered arm. The extrusion profile thickness of the cantilevered arm and hook are illustrated to be about substantially equal, although some variation of thickness may be employed, as will be discussed. A substantially uniformly thick extrusion profile for the arm and the hook structure is preferred; it provides a product of substantially equal strength throughout and thus is less susceptible to distortion. Optionally, the hook (i.e., the leg 14 and hook 12) may be thicker but not over about two times the thickness of the mounting arm (at its portion of greatest thickness).

The mounting arm 20 is best formed to be straight and of substantially uniform thickness throughout its length. It may be thinner at its cantilevered end 24 than at its base end 22 and might be somewhat wedged in profile, but best results are achieved in extrusion by using a substantially uniformly thick mounting arm profile. The profile thickness should lie between about 0.02 inch (about 0.5 mm) and about 0.08 inch (about 2 mm), and preferably between about 0.03 inch (about 0.8 mm) and about 0.06 inch (about 1.5 mm), with about 0.04 inch (about 1 mm) being close to ideal for reliable easy friction mounting.

The cantilevered arm is equipped with at least one (and preferably more) resiliently deformable transversely extending fins 25 that angularly project outward from the arm and backward toward the hook. All fins have an extrusion profile thickness less than the thickness of the mounting arm at the location on the mounting arm from which the fin projects. Further, the fin thickness will generally lie between about 0.01 inch (about 0.25 mm) and about 0.04 inch (about 1 mm), preferably between about 0.015 inch (about 0.37 mm) and 0.03 inch (about 0.8 mm), with about 0.02 inch (about 0.5 mm) being close to ideal. The fins should be uniformly thick throughout but may taper and thus exhibit a wedge shape with the thinnest part at the outer edge 27.

These fins are for frictionally engaging opposing face-to-face surfaces when the mounting arm is slidably inserted therebetween. Ideally, the fins project outwardly at approximately a 45 degree angle, although the angle of outward projection for the fins may vary from possibly as little as about 25 or 30 degrees (indicating a sharp backward tilt of the fins toward the hook) up to about 60 or 70 or even 80 degrees (indicating a backward tilt of the fins in an angular direction toward the hook but not an extreme tilt toward the hook end of the mounting arm). Ideally, the angular tilt of the fins toward the hook is kept around 45 degrees or between about 35 degrees and 55 degrees for easy insertion of the mounting arm during mounting and convenient practical removal of the mounting arm after the hook is no longer needed.

The perpendicular height of the fins from the face surface of mounting arm 20 (from which they project) to the outer edge 27 of the fins will vary depending on the angle employed for the fins. The best fins for friction mounting have a height (measured perpendicular to the face surface) that generally will be at least about equal to the profile thickness of the mounting arm up to about twice or even about three times that thickness. Ideally, the perpendicular height for the fins is about 0.06 inch (about 1.5 mm) for fins having a profile thickness of about 0.02 inch and mounting arms having a profile thickness of about 0.04 inch (about 1 mm). Fins that are extremely low in perpendicular height (i.e., no higher than about equal to the profile thickness of the fins) tend to lose their effectiveness as resiliently deformable friction mounting elements. Perpendicular fin heights at least about twice the extrusion profile thickness of the fin are most preferred.

The fins 25 on the mounting arm should be in paired relationship so that an upper fin and a lower fin project out from the arm opposite each other (i.e., with a fin projecting out from each opposite face of the mounting arm at substantially the same location along its length). The paired relationship on the mounting arm gives an arrow point effect, as illustrated. While displacement of the location of the upper fins from the location of the lower fins may sometimes be useful, the paired relationship gives the best anchoring (i.e., equal outward pressure exerted by the paired fins at the same location on the opposite face surfaces of the profile of the mounting arm) consistent with ease of insertion of the mounting arm and reliability of the mounting. Preferably at least two pairs of fins, as illustrated, will be employed on the mounting arm. Normally no more than two are needed, although three or four pairs may be used.

The size and angular relationship of all fins should be substantially the same. The angular distance of projection of all fins from a face surface of the mounting arm should be about equal. Further, the linear distance along the arm 20 between fins on each face surface should be at least about two times greater than the angular distance of projection of the fins from the face surface. (The angular distance of projection extends from a face surface as at 29 on the mounting arm to the outermost fin edge 27.) The spacing between fins should always be such that a fin flattened against a face of the mounting arm has plenty of clearance or separation from an adjacent flattened fin on the same face side of the mounting arm. Indeed, the preferred spacing of a pair of fins from any other pair (i.e., spacing between fin base connections 29 to an arm) is at least three or even at least five times up to about 10 or even 15 times greater than the distance of projection of a fin from its base connection to its outermost edge 27. The reason for such spacing is to enhance stability of anchoring of the mounting arm between face to face surfaces. Widely spaced pairs of fins give spaced friction anchoring grips on the face-to-face surfaces, which contributes to stable anchoring without a teeter-totter effect. Preferred spacing also enhances the reliability of mounting when the mounting arm is pressed between face-to-face surfaces that are not in near contact with each other (i.e., where the face-to-face surfaces may be spaced apart a distance slightly greater than the thickness of the projecting mounting arm).

It is emphasized that extrusion creates the features just described, but the extruded material has a long length. Thus, after extrusion, the length of extruded material is cut into discrete hangers of the invention. The cuts form the side edges 26 and 28 which define the width of the hanger. The uniform width dimension is perpendicular to the extrusion profile. It is important to recognize that the width of the entire plastic hanger, including its hook and mounting arm and deformable fins, is uniform. A feature of the width is that it is always greater than the extrusion profile thickness of the mounting arm, and less than the length of the mounting arm. The width contributes to a stable oriented position for the hook when the hanger is mounted. Generally the width dimension of the entire hanger will lie between about 0.1 inch (about 0.25 cm) and about 1 inch (about 2.5 cm), with the preferred width between about 0.25 inch (about 0.6 cm) and about 0.75 inch (about 2 cm). A width of about 0.5 inch (about 1.3 cm) is practical and gives excellent stabilization of the hanger when it is mounted.

Importantly, the cantilevered mounting arm has a straight length greater than the width dimension of the hanger. This straight length, however, is no greater than about 4 inches (or about 10 centimeters) and preferably is no greater than about 3 inches (or about 7.5 cm). The straight length should be at least 1 inch (or at least about 2.5 cm), and preferably at least about 1.5 inches (about 4 cm), with about 2.75 inches (about 7 cm) being close to ideal for versatile mounting performance between face-to-face surfaces. Although the length can vary beyond the extremes mentioned, the problem with extremely short lengths (for single mounting arm hangers) is that they weaken the mounting capability; and extremely long lengths create unnecessary mounting problems without commensurate benefit, and also risk causing damage to base structures.

Figure 3:
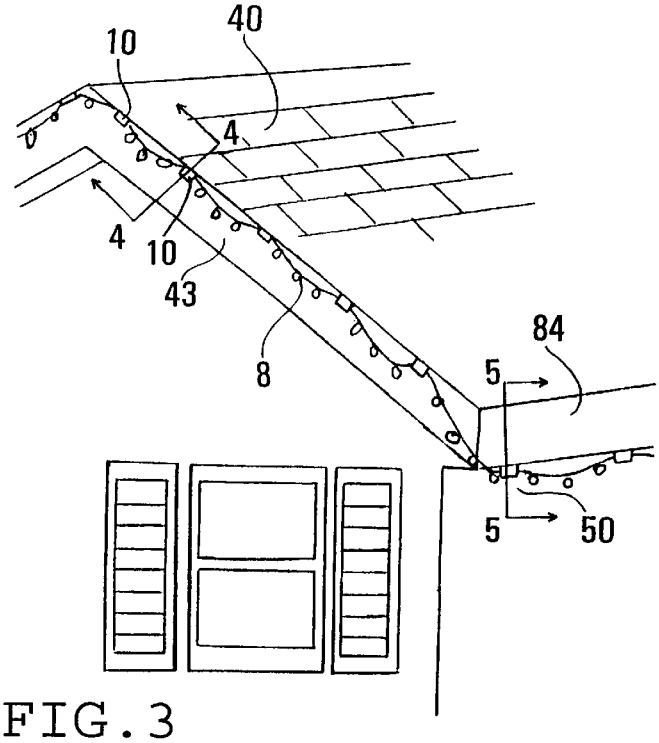
FIG. 3 is a schematic perspective view of a fragment of a building, illustrating a string of lights mounted according to the invention at locations along the slope of the rake of the building roof and at an eave of the building.

Referring now to FIG. 3, hangers 10 having a single arm mounting structure are useful to hang strings of lights 8 along the rake 43 of a roof. They can be used in other environments, and are especially useful anywhere a hanger is to be mounted at a location having face-to-face surfaces that are not permanently fastened together. In fact, the face-to-face surfaces must be slightly spaced from each other or at least must be capable of being sufficiently pushed apart by the single mounting arm of the hanger to permit anchoring of the single mounting arm between the surfaces without damaging the face-to-face surfaces. As shown in FIG. 4, shingles 40 over a metal drip edge or other underlying surface 42 along the rake 43 of a roof form face-to-face surfaces for receiving a single arm mounting hanger 10 of the invention. Any other face-to-face structural surfaces having an edge at which the single mounting arm of the hanger may be inserted can provide a suitable place for mounting the single arm hanger 10 illustrated in FIGS. 1 and 4.

When the friction-mountable single arm plastic hanger is put in mounted position between opposing face-to-face surfaces 40 and 42, the resiliently deformable transversely extending fins 25 are bent to a closer angular relationship to a face surface of the mounting arm 20 and thus toward a more acute angle with respect to a face surface of the mounting arm than they exhibit in the unmounted condition. The resilient nature of the fins, however, causes them to continually press against the opposing face-to-face surfaces 40 and 42 even though the opposing face-to-face surfaces may be in a somewhat spaced condition (but never spaced so greatly as not to cause bending resilient deformation of the fin during the mounting step). If such surfaces are substantially adjacent to each other, with little or no spacing therebetween, the nature of the mounting arm is such that it will nudge the surfaces slightly apart and anchor itself in a mounted condition as a result of the flexible resiliently deformable fins being substantially flattened. Once mounted, the hook 12 is easily accessible for the hanging of any string or wire of electric lights 8 or the hanging of garlands or any of a number of lightweight decorations such as balls, balloons, streamers, etc.

Figure 2:
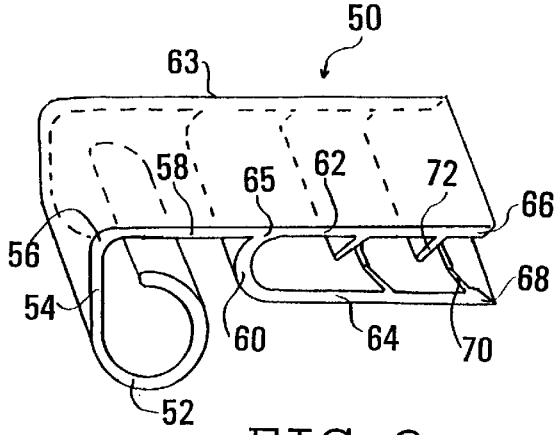
FIG. 2 is a schematic perspective view of the new friction-mountable plastic hanger of the invention having a U-shaped mounting element or assembly with parallel cantilevered mounting arms.
Figure 5:
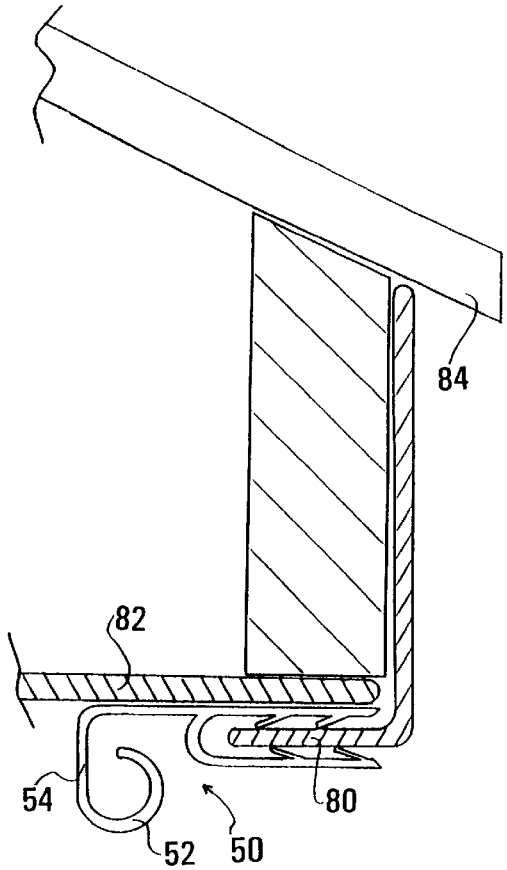
FIG. 5 is a fragmentary schematic sectional view taken on line 5—5 of FIG. 3, illustrating a hanger of the invention having a U-shaped dual arm mounting element frictionally anchored on a plate such as the flange of the fascia at the eave part of a building structure (with the spacing between parts exaggerated to enhance clarity of the illustration).

The dual arm hanger 50 now will be discussed by reference to FIGS. 2, 3, and 5. The extrusion profile thickness for the hook and arms of the dual arm hanger are in all respects as described for the single mounting arm hanger.

Also the width of the dual arm and all of its features (i.e., the width from edge 62 to edge 65 of FIG. 2) is as discussed for the single arm hanger. The significant difference is at the U-shaped mounting element (sometimes called assembly). Thus, the extrusion profile of the dual mounting arm hanger 50 illustrated in FIGS. 2 and 5 has an upwardly curved hook 52 at the lower end of a depending leg 54. It has a spacing arm section 58 extending between the upper base end 56 of the leg 54 and the base part 60 of the U shape. (A spacing arm section may be unnecessary if the hook with its depending leg were located directly at the U curvature 60 of the U-shaped structure.) The U shape for the dual arm assembly is somewhat analogous to a clip in that the U-shaped structure 60 is designed to receive within its cavity (i.e., the part between arms 62 and 64) a thin structural member such as a plate or flange 80 of metal supporting a soffit 82 under an eave 84 of a building (see FIGS. 3 and 5). A plate 80 of metal or other thin material is ideally suited to be received between parallel cantilevered arms 62 and 64 of the dual armed hanger 50.

The cantilevered mounting arms 62 and 64 (see FIG. 2) are in parallel cantilevered relationship in their extension from the base part 60 of the U shape. Their interior faces (i.e., interior facing surfaces) are equipped with resiliently deformable transversely extending fins 70, 72 that project angularly backward toward the hook end of the hanger (i.e., toward the base of the U shape) and away from the outer cantilevered ends 66 and 68 of the arms. The thickness and angularity features of the fins for the U-shaped mounting assembly are in all respects the same as those features for the single mounting arm hanger, but the fins of the dual arm assembly are most preferably not in a paired relationship. Ideally, the fins on the interior faces are offset from each other. Thus, the fins 72 on the arm 62 are set relatively further away from the outer end 66 of the arm 62 than the fins 70 are from the outer end 68 of arm 64. This is preferred for a grip-type U-shaped mounting assembly. It makes for easier slide-on friction mounting with reduced tendency toward binding (i.e., reduced tendency to resist slide-on mounting). Nevertheless, the option exists to place the fins directly opposite each other on the interior facing surfaces. That arrangement is not ideal and may sometimes create some degree of binding resistance to slide-on mounting as well as slide-off removal of the U-shaped mounting arm structure after the hanger is no longer needed.

At least one fin is necessary on each of the arms of the U-shaped assembly, and preferably, each interior face will have two or possibly three fins projecting interiorly within the U shape. All fins should have substantially equal angular projection distances from the face of the mounting arm to their outermost edges. The linear spacing distance between fins on the same internal face of the U shape should be at least about equal to the angular projection distance of the fins. Preferably that linear spacing should be at least about twice the angular projection distance of the fins. The linear spacing distance may be as great as up to about four or possibly five times the projection distance of the fins. Generally, the spacing distance will not exceed about three times the outward projection of the fins from the face of the U shape, for reasons that will become evident.

An especially significant feature of the U-shaped parallel cantilevered mounting arm structure is that the cantilevered arms of the U shape have an extrusion profile length (i.e., from the U-shaped connection to their ends 66 and 68) that generally will not be as great as that for the single mounting arm hanger (and this feature limits the spacing distance between fins on a single interior face surface). The reason for the shorter length is because the U-shaped dual arm mounting assembly will most frequently be employed for mounting on a thin strip or flange-like building structure 80 as illustrated in FIG. 5. Thus, the length of each arm of the U-shaped mounting assembly, while theoretically capable of being as great as the single arm length, will most preferably not exceed about 1 inch (about 2.5 cm) or possibly about 1.25 inch (about 3 cm). The length generally should be at least about ½ inch (about 1.2 cm) and most preferably will be about ¾ inch (about 2 cm). Greater lengths contribute little to good mounting of the U shape and interfere with versatility of use for the mounting structure.

Yet another feature of the U-shaped structure is that of the spacing distance between the U-shaped arms. When the extrusion profile wall thicknesses for all parts other than the fins is about 0.04 inches (about 1 mm), and the extrusion profile wall thicknesses for the fins is about 0.02 inch (about 0.5 mm), the ideal spacing distance between the mounting arms is about 0.15 inch (about 0.38 mm). It, however, should be recognized that the interior distance between the parallel cantilevered arms can vary from the optimum or ideal. Thus, the interior space may vary from a minimum of about 0.1 inch (about 2.5 mm) up to about 0.3 inch (about 8 mm)-or even more where the strip of material to be accommodated within the cavity of the U shape is proportionally larger. Below the minimum interior spacing distance just noted, it becomes difficult to provide internal fins of the size and functional performance required.

A significant feature of the invention is the basic small size of the hangers taught herein-although larger sizes than illustrated and described may have some uses. The best practice of the invention is for hangers that are small or almost insignificant in size. They are not even perceptible when viewed from a distance.

The hangers are formed of plastic, and the plastic used in their formation may vary greatly. Any relatively stiff (but not necessarily absolutely rigid) plastic may be employed for all parts other than the most ideal of angularly projecting fins. The plastic of the fins is co-extruded with the plastic for all parts other than the fins and ideally is softer and somewhat elastomeric in nature, at least to the extent of having the property of recovering from deformation even though the recovery may be not of the instantaneous type such as exhibited by a common rubber band. Thus, the flexible fins are characterized as being resilient because they do recover from deformation. In that respect, they exhibit a sufficient resistance to remaining deformed so as to possess the necessary resilient property. Polyvinyl chloride is a very advantageous plastic to employ since it may be formulated so as to exhibit the stiffness for all parts other than the fins and also may be formulated so as to exhibit the resilience that is important for the fins. An especially suitable exterior grade extrusion compound of polyvinyl chloride plastic to employ for all parts other than the fins is available commercially under the trade name "GEON 87703" from B. F. Goodrich Co., Geon Vinyl Division, 6100 Oak Tree Boulevard, Cleveland, Ohio 44131. It has a D-scale durometer hardness of about 84 under the test of D-2240 of the American Society for Testing Materials (ASTM). A softer polyvinyl chloride plastic exhibiting the resilience needed for the fins is available commercially under the trade name "POLYCOR R143 AE" from Synergistics. It has a Shore A hardness of about 66. Another plastic capable of formulation to satisfy stiffness requirements and also formulation to satisfy the softer resilience features is that of the urethane family. A great variety of plastic compositions can give satisfactory resilience results for the fins, and an equally great variety of plastics can give satisfactory stiffness or structural integrity for the stiff areas of the hangers. The stiff areas may even be formed of rigid plastic material. But the stiff areas at the thicknesses employed need not be so rigid as to exhibit the stiffness of a nylon bearing, although they may be that rigid. The critical requirement for the stiff parts of the tiny hanger articles is that, under the limited conditions of use, they must retain their structural integrity and structural performance without being bent out of shape-even though the stiff parts may be somewhat capable of being bent or slightly flexed. Even so, they are appropriately called stiff in performing their structural functions, and never are so flimsy as to exhibit the characteristics of a common rubber band. On the other hand, the resilient fins may indeed exhibit the resilience of a rubber band, although that high degree of resilience is unnecessary. The invention is not limited to any particular plastic or plastic formulation. Experts in formulating plastics will readily recognize that many plastics are capable of being formulated to exhibit sufficient stiffness to form the stiff parts of the hanger. Similarly, a multitude of plastics may be formulated to exhibit sufficient resilience and deformability for the fins, so that they are soft enough not to scratch or otherwise damage surfaces against which they are to be frictionally mounted.

Those skilled in the art will readily recognize that this invention may be embodied in still other specific forms than illustrated without departing from the spirit or essential characteristics of it. Thus, the illustrated embodiments are to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A friction-mountable plastic hanger having an extrusion profile that defines a stiff depending hook for hanging an object and at least one stiff cantilevered mounting arm equipped with resiliently deformable transversely extending fins that angularly project from said mounting arm in a direction backward toward said hook, said fins being bendable for deformably frictionally engaging a structural surface when mounting the hanger, said entire plastic hanger having a uniform width dimension perpendicular to said extrusion profile greater than the extrusion profile thickness of said mounting arm, said width dimension being between about 0.1 and about 1 inch.

2. The hanger of claim 1 wherein said fins have an extrusion profile thickness less than the extrusion profile thickness of said mounting arm and wherein said fins have a perpendicular height from said mounting arm of at least about twice the extrusion profile thickness of said fins.

3. The hangar of claim 1 wherein said mounting arm has an extrusion profile thickness between about 0.02 inch and about 0.08 inch.

4. The hanger of claim 1 wherein said fins have an extrusion profile thickness between about 0.01 and about 0.04 inch.

5. The hanger of claim 1 wherein said hook has an extrusion profile thickness about equal to the extrusion profile thickness of said mounting arm up to about two times the extrusion profile thickness of said mounting arm.

6. The hanger of claim 1 wherein said cantilevered mounting arm is the sole mounting arm for said hanger and wherein said fins are arranged to project on opposite faces of the extrusion profile of said mounting arm, the spacing between any two fins on one face of said mounting arm being at least about two times the outward projection of said fins.

7. The hanger of claim 6 wherein said fins have an extrusion profile thickness less than said mounting arm and wherein said fins have a perpendicular height from said mounting arm of at least about twice the extrusion profile thickness of said fins.

8. The hanger of claim 7 wherein said mounting arm has an extrusion profile thickness between about 0.02 inch and about 0.08 inch and wherein said fins have an extrusion profile thickness between about 0.01 and about 0.04 inch.

9. The hanger of claim 6 wherein two fins project from each said face of said mounting arm and wherein the fins on opposite faces of said mounting arm project in paired relationship.

10. The method of affixing a hook to a building structure equipped with opposing face-to-face surfaces and an exposed edge for access between said face-to-face surfaces, comprising forming a hanger in accordance with claim 6 and inserting the mounting arm of said hanger between said opposing face-to-face surfaces to cause said fins on said mounting arm to resiliently deform by bending into a frictionally engaging relationship against the opposing face-to-face surfaces without puncturing either surface of said face-to-face surfaces.

11. The hanger of claim 1 wherein said extrusion profile defines a second cantilevered mounting arm, said two cantilevered mounting arms having substantially equal extrusion profile thicknesses, having a substantially parallel relationship to each other and having interior facing surfaces from each of which said fins project.

12. The hanger of claim 11 wherein said fins have an extrusion profile thickness less than the extrusion profile thickness of said mounting arms and wherein said fins have a perpendicular height from said mounting arms of at least about twice the extrusion profile thickness of said fins.

13. The hanger of claim 11 wherein said mounting arms have an extrusion profile thickness between about 0.02 inch and about 0.08 inch.

14. The hanger of claim 11 wherein said fins have an extrusion profile thickness between about 0.01 and about 0.04 inch.

15. The hanger of claim 11 wherein said hook has an extrusion profile thickness about equal to the extrusion profile thickness of said mounting arms up to about two times the extrusion profile thickness of said mounting arms.

16. The hanger of claim 11 wherein said fins on one said interior face surface of said parallel arms are offset from a paired relationship to the said fins on the other said interior face of said parallel arms.

17. The method of affixing a hook to a building structure having a plate member with opposite faces and an exposed edge for access to said opposite faces of said plate member, comprising forming a hanger in accordance with claim 11 and sliding said parallel mounting arms of said hanger over said faces of said plate member to cause said fins on said parallel mounting arms to resiliently deform by bending into a frictionally engaging relationship against said opposite faces of said plate member without puncturing said plate member.

18. A friction-mountable plastic hanger having an extrusion profile that defines a stiff depending hook for hanging an object and a stiff cantilevered mounting arm with its opposite face surfaces equipped with resiliently deformable transversely extending fins that angularly project from said mounting arm in a direction backward toward said hook for frictionally engaging opposing face-to-face structural surfaces when said mounting arm is slidably inserted therebetween, said mounting arm having an extrusion profile thickness between about 0.02 and about 0.8 inch and said fins having an extrusion profile thickness less than the extrusion profile thickness of said mounting arm and lying between 0.01 and about 0.04 inch, said fins having a perpendicular height from said mounting arm of at least about twice the extrusion profile thickness of said fins but no greater than about 0.2 inch, said fins on each face surface of said mounting arm being substantially equal in their distance of angular projection from the face surface and being spaced apart a distance at least about two times greater than the angular distance of their projection from the face surface, said entire plastic hanger including its hook and mounting arm and deformable fins having a uniform width dimension perpendicular to said extrusion profile greater than said extrusion profile thickness of said mounting arm and lying between about 0.1 and about 1 inch, said cantilevered mounting arm having a straight extrusion profile length greater than said width dimension, said length being between about 1.0 inch and about 4.0 inch, said hook having an extrusion profile thickness about equal to the extrusion profile thickness of said arm up to about two times the extrusion profile thickness of said arm.

19. A friction-mountable plastic hanger having an extrusion profile that defines a stiff depending hook for hanging an object and a stiff U-shaped mounting structure having a pair of parallel cantilevered mounting arms with interior facing surfaces equipped with resiliently deformable transversely extending fins that angularly project from said interior facing surfaces and backward toward said hook, said cantilevered arms with their interior projecting fins being adapted to be frictionally mounted over opposite faces of a plate structural member, said arms of said U-shaped structure having a substantially equal extrusion profile thickness between about 0.02 and about 0.8 inch and said fins having an extrusion profile thickness less than the extrusion profile thickness of said arms and lying between 0.01 and about 0.04 inch, said fins having a perpendicular height from said interior facing surfaces of said arms of at least about twice said extrusion profile thickness of said fins but no greater than about 0.2 inch, said fins on said interior facing surfaces of said arms being substantially equal in their distance of angular projection from the face surface and being spaced apart a distance at least as great as the angular distance of their projection from the face surface, said entire plastic hanger including its hook and U-shaped structure and deformable fins having a uniform width dimension perpendicular to said extrusion profile greater than said extrusion profile thickness of said arms and lying between about 0.1 and about 1 inch, said cantilevered mounting arms of said U-shaped structure having a substantially equal extrusion profile length greater than said width dimension, said length of said mounting arms of said U-shaped structure being between about 0.5 inch and about 1.5 inch, said hook having an extrusion profile thickness about equal to the extrusion profile thickness of said arms up to about two times the extrusion profile thickness of said arms.

* * * * *